US005408772A

United States Patent [19]

Pettyjohn

[11] Patent Number: 5,408,772

[45] Date of Patent: Apr. 25, 1995

[54] SOUND PLATE

[76] Inventor: Brad M. Pettyjohn, 2 Oriole Dr., Poughkeepsie, N.Y. 12601

[21] Appl. No.: 726,854

[22] Filed: Jul. 8, 1991

[51] Int. Cl.[6] ..... G09F 13/02

[52] U.S. Cl. ..... 40/204; 40/442; 40/200

[58] Field of Search ..... 40/206, 442, 463, 457, 40/204, 700; 362/83.2, 276, 802, 806

[56] References Cited

U.S. PATENT DOCUMENTS

| | | | |
|---|---|---|---|
| 4,355,348 | 10/1982 | Williams | 362/276 |
| 4,857,890 | 8/1989 | Solow | 362/83.2 |
| 5,029,053 | 7/1991 | Solow | 362/83.2 |

FOREIGN PATENT DOCUMENTS

| | | | |
|---|---|---|---|
| 995892 | 8/1976 | Canada | 40/455 |
| 2335901 | 8/1977 | France | 40/457 |

*Primary Examiner*—Kenneth J. Dorner
*Assistant Examiner*—Cassandra Davis
*Attorney, Agent, or Firm*—Joseph B. Taphorn

[57] ABSTRACT

A rectangular vehicle license plate frame includes side columns which mount printed circuit boards internally. The printed circuit boards mount yellow dot transformers and an integrated chip and light a number of light emitting diodes mounted on the external surface of the columns proportionate to the strength of the signals received. The strength of the signals received is dependent on the output of the respective channels of the vehicle's stereo system to which the printed circuit boards are connected by appropriate wires. Connections to the vehicle's battery provide power for energizing the respective diodes. Thus the license plate frame displays an unlimited variation of patterns in which various numbers of LEDs are illuminated in accordance with the strength of the outputs of the stereo system in rhythmic-like fashion.

15 Claims, 4 Drawing Sheets

SOUND PLATE

BACKGROUND OF THE INVENTION

1. Field of the Invention

This invention relates to frames for vehicle license plates and more particularly to a high-visibility license-plate frame wherein a plurality of lights are lit according to the strength of a vehicle's music-system electrical output signals.

2. Prior Art

Lighted license-plate frames are well known. See for example U.S. Pat. No. 4,857,890 issued to Solow on Aug. 15, 1989. In devices according to that patent, the license-plate frame lights are lighted whenever the vehicle's running lights are on, and lit brighter whenever the brake lights are put on.

Other U.S. Pat. Nos. include Hashimoto (4,034,245), Young (4,358,754), and Anderson (4,359,669). Hashimoto discloses a decorative light display wherein the intensity of three lamps varies respectively according to the strength of the treble, mid and base range of a stereo output. Young shows a sound-actuated light display which switches lights on and off in response to variations in the volume or amplitude of the ambient sound. Anderson teaches a circuitry for sound modulating fluorescent lamps in the on condition, which lamps flash in the absence of adequate sound volume.

SUMMARY OF THE INVENTION

It is an object of this invention to proved a license-plate frame that is highly visible and attention generating.

It is another object of the invention to provide a license-plate frame that displays an unlimited variation of patterns.

It is yet another object of the invention to provide a license plate frame wherein the lights are displayed in rhythmic-like fashion.

It is still another object of the invention to provide a license-plate frame wherein the light-energizing electronics are contained within the frame.

The objects of the invention are accomplished by mounting a set of lights on each side of the frame along with the electronics for energizing those lights. The electronics in the sides of the license-plate frame are connected to the respective electrical-output channels of a vehicle's music system. The electronics,powered by the vehicle's battery, transform the channel signals to energize a number of lights according to their peak levels. A printed circuit board in each side of the frame mounts the electronics therefor, and is interconnected with the vehicle power supply.

In a preferred embodiment, the channel electrical outputs of a vehicle's stereo system to its speakers, are connected to the electronics controlling the operation of the respective sets of light-emitting diodes (LEDs). The respective sets of LEDs are arranged in columns along the two sides of the license plate frame, and the number of LEDs lit from the bottom is proportionate to the instantaneous peak level or strength of the corresponding stereo channel. A visual display takes place along the sides of the vehicle's license plate which is highly visible and attention generating, besides being entertaining.

An advantage of the invention is that it promotes safety. The driver of a following vehicle is enticed to keep his eyes focused on the vehicle in front of him, causing him to take note of any change in the preceding vehicles operation such as the lighting of brake lights.

DETAILED DESCRIPTION OF A PREFERRED EMBODIMENT

Figure 1:
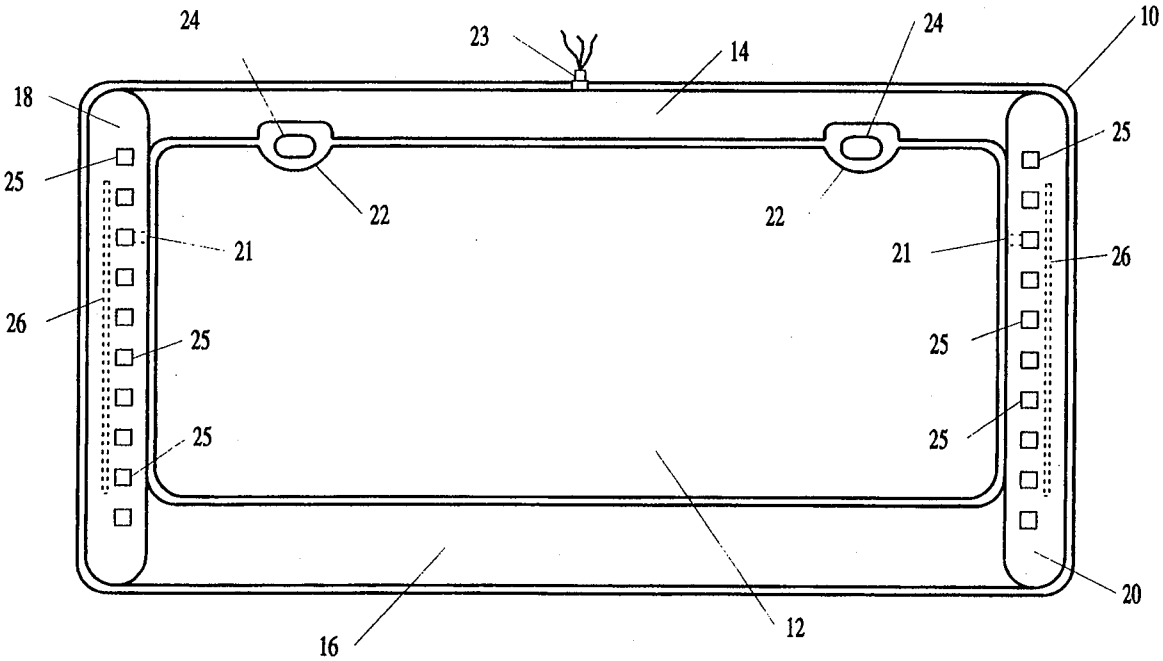
FIG. 1 is a front view of a license plate frame constructed according to the invention and showing a license plate in place.

Referring now more particularly to the drawings, FIG. 1 shows a rectangular frame generally indicated by the numeral 10 and embracing a license plate 12. The frame includes upper top and lower bottom row-like portions or rails 14 and 16 respectively, and left and right hand side portions or columns 18 and 20 respectively. The upper top rail 14 includes depending tabs 22 having holes or slots 24 for alignment with holes in the upper portion of the license plate 12for mounting of the frame 10 on the license plate 12. The upper rail 14 is hollow, carrying electrical wires to the left and right columns, and is provided with an opening 23 for passing power and stereo signal wires to and from the frame.

Figure 5C:
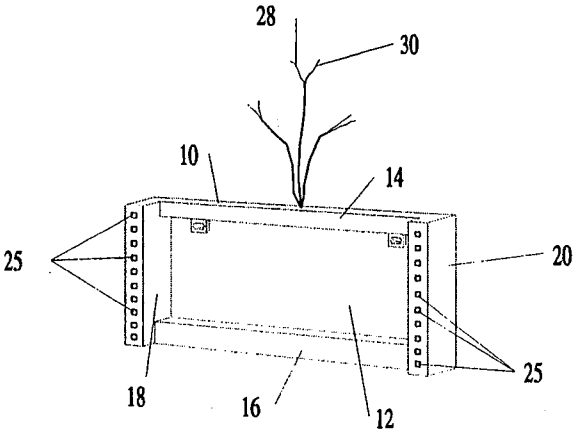
FIG. 5 is a diagrammatic view of a vehicle incorporating the invention and having a license plate, a stereo system, and a power source (battery).
Figure 5B:
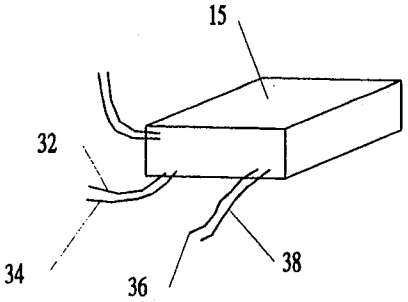
Figure 5:
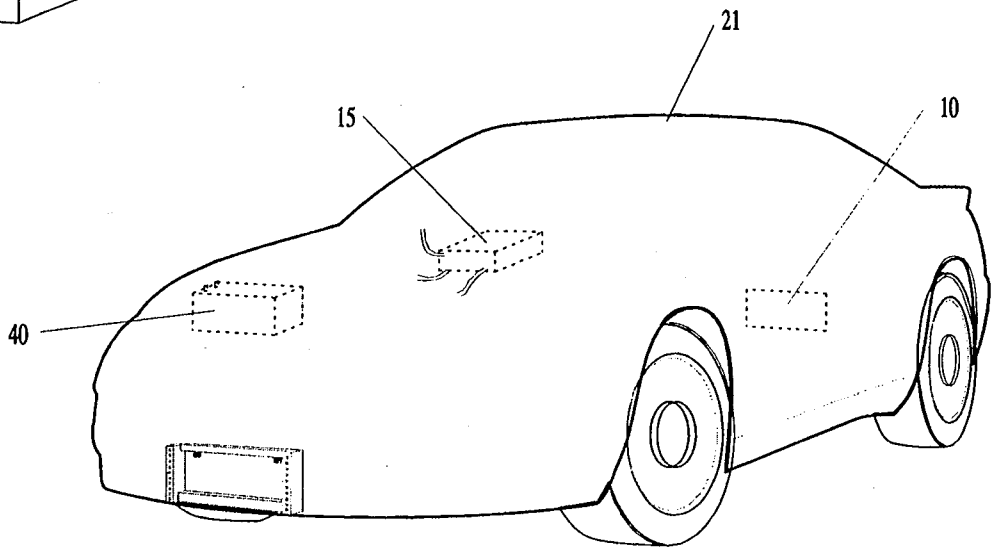
Figure 5A:
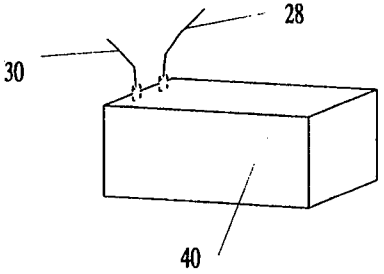
Figure 6:
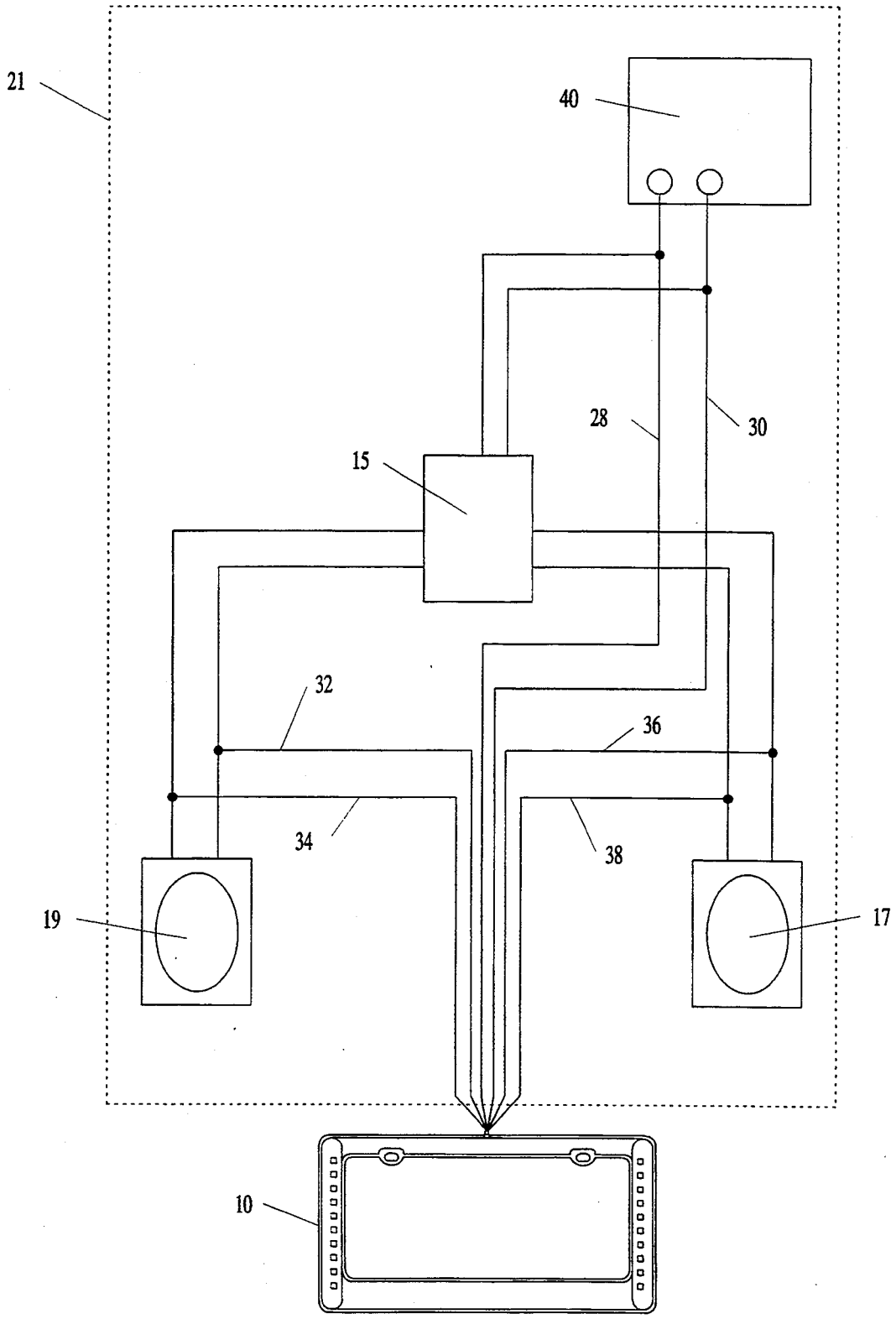
FIG. 6 is a schematic wiring diagram of the invention's involvement with vehicle components of FIG. 5.

The frame left and right columns 18 and 20 each mount on the outer surface a plurality of lamps or light emitting diodes (LEDs) 25. The number of LEDs that are lit in each column is proportional to the instantaneous strength or peak of the audio signal in the corresponding channel of the music system consisting of a stereo radio tuner 15 and right and left hand speakers 17 and 19 of the vehicle generally indicated by the number 21 (FIGS. 5 and 6).

Figure 3:
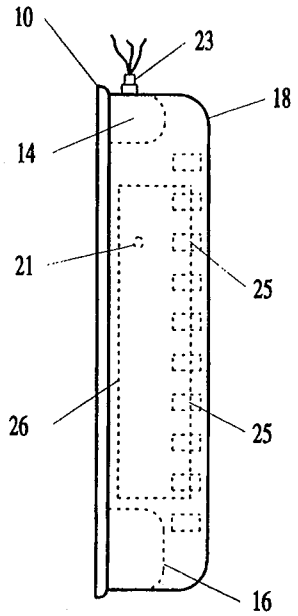
FIG. 3 is a left hand end view of the license plate frame of FIG. 1.
Figure 2:
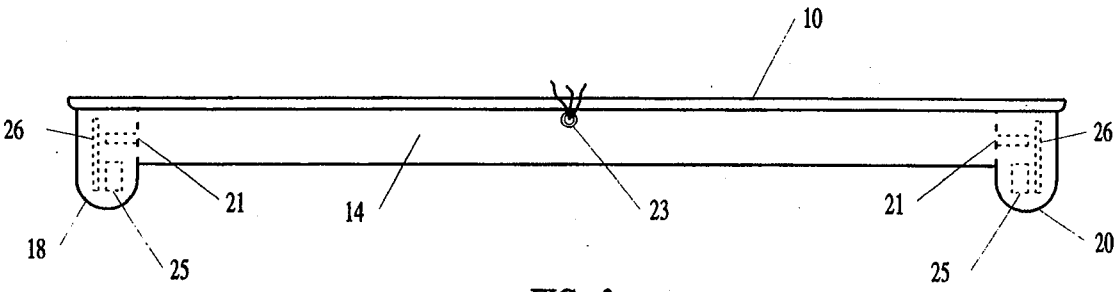
FIG. 2 is a top view of the license plate frame of FIG. 1.

As seen in FIG. 2, the side columns of the license plate frame project forwardly from the upper and lower rails 14 and 16. The columns each mount, in addition to the LEDs 25 in the outer surfaces thereof, and as seen in FIG. 1, internally, printed circuit boards 26 carrying the column associated circuit components or electronics. The printed circuit boards 26 and associated components distribute the electrical power to the appropriate number of LEDs. The internal mounting of the circuit boards 26 in each column minimizes the external wiring requirements for the sound plate: limiting the external requirements to set of power wires 28 and 30 and to sets of input wires 32 and 34 and 36 and 38 from each of the right and left hand stereo channels of the music system. Of course the universal ground could be employed to eliminate the return wire for each wire set.

Figure 4:
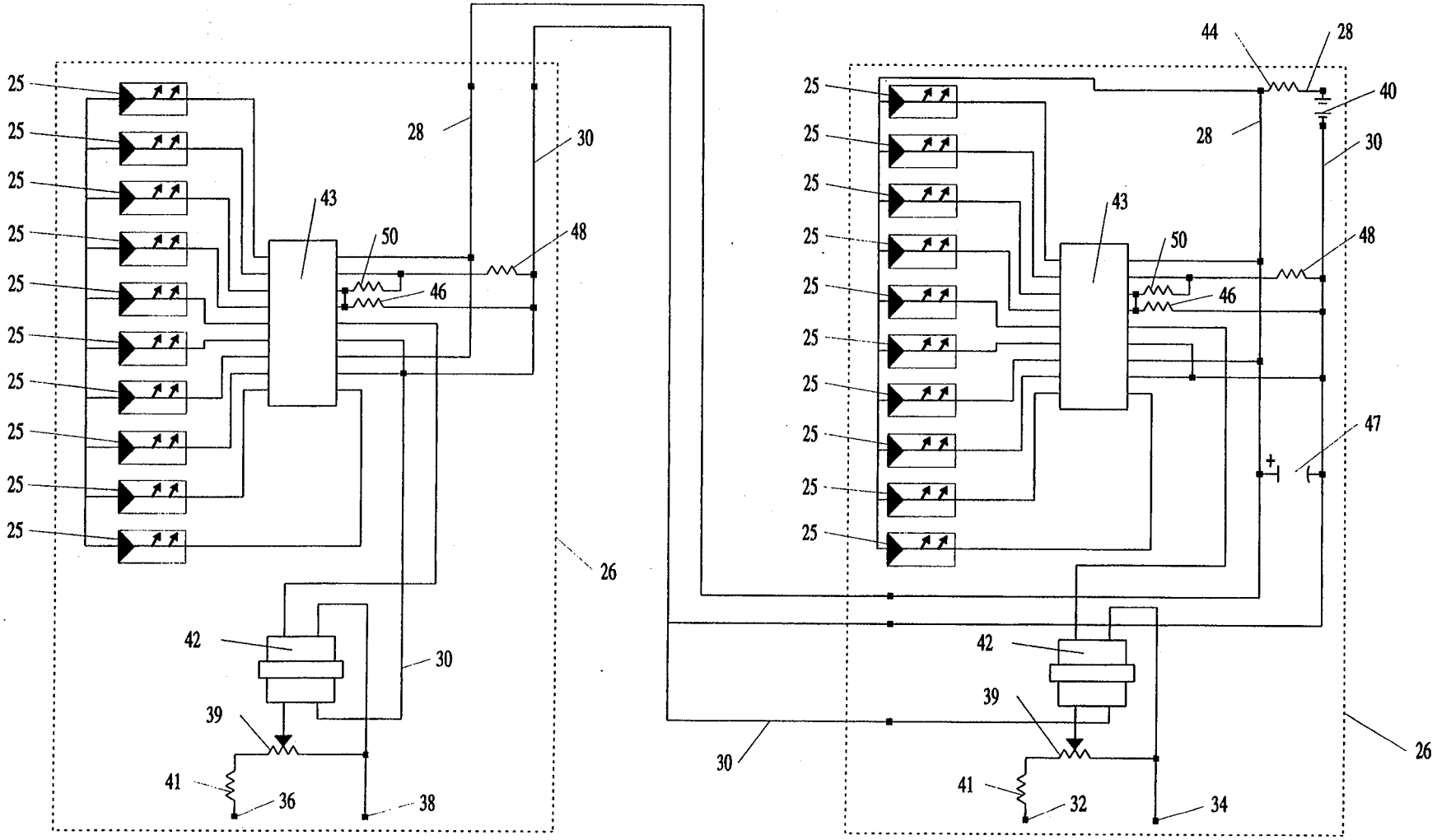
FIG. 4 is a diagram of the circuitry employed in the invention.

The circuitry for operating the respective sets of LEDs in the right and left hand columns is shown in FIG. 4. Basically the circuitry may be the same as that set forth for a Stereo Power Meter Kit C6411 marketed by Chaney Electronics Inc. via documents dated Aug. 2, 1988 and Jul. 28, 1988, and is essentially the same for each printed circuit board and its mounted components. The power source, which may be the conventional vehicle 12 volt battery 40, feeds a transformer 42 (a conventional audio transformer) connected to each stereo channel by the terminal of a trimmer resistor 39 mounted in series with a current limiting resistor 41 across the channel wires 36 and 38 or 32 and 34. Each transformer 42 feeds a corresponding monolithic integrated circuit (IC) chip 43 marketed as LM3916N Dot/Display Driver by National Semiconductor Inc. An LM3916 IC senses analog voltage levels and drives up to ten LEDs as a moving dot display. Each LM3916 chip 43 is connected to wires 28 and 30 for powering by the battery 40 through a current limiting resistor 44. A capacitor connected across the wires aides in stabilizing the voltage. Resistors 46 and 48 limit current to the respective chips 43, and resistors 50 work with resistors 46 to form a voltage divider. Thus the IC chip 43 receives analog input signals representing the instantaneous peak voltages in the respective music system stereo channels and power from the battery 40, and through ten outlets powers up to ten light emitting diodes (LEDs) 25. The circuitry tracks the audio output level or signal of the stereo channel and lights a number of diodes corresponding to the current audio level.

Openings 21 (FIG. 2) in the outsides of the frame columns 18 and 20 allow insertion of a screw driver or other tool to adjust the trimming resistors 39 on the printed circuit boards 26.

The printed circuit board assembly for each of the columns and stereo output channels may be essentially identical.

The license plate holder with its LEDs and printed circuit boards are manufactured as an essentially sealed-against-dust device. The only openings to the exterior are those necessary to accommodate the wires 28 and 30 from the power supply and the wires 32 and 34 and 36 and 38 from the two stereo channels, as the LEDs 25 essentially seal the holes in which they are mounted in conventional fashion.

In installation, the license plate frame 10 would be placed over a license plate 12 on a vehicle 21, the openings 24 in the tabs 22 aligned with openings in the license plate, and fastening devices such a bolts inserted through the openings to hold the license plate frame firmly on the license plate which would be secured to the vehicle in the conventional manner. The connection of power supply wires 28 and 30 and the stereo wires 32 and 34 and 36 and 38 would be made to the appropriate instrumentalities in conventional fashion.

In use, when the vehicle stereo music system is empowered, signals would be picked off of the wires 32 and 34 and 36 and 38 for the respective channels and delivered to the corresponding printed circuit boards 26 in the columns 18 and 20 of the license plate frame 10. As the amplitude of the signals increased in a stereo channel, additional LEDs 25 in the corresponding column would be lit. Then, of course, as the amplitude decreased, corresponding fewer LEDs would be lit in the column. And of course the number of LEDs lit in each column would vary independently of the other, being purely related to the strength of the stereo signal in the corresponding channel.

While applicant has disclosed a preferred embodiment of the invention and it will be evident to those skilled in the art that other embodiments employing principles of the invention may readily be fabricated. Accordingly it is intended to be limited only by the spirit or scope of the appended claims.

What is claimed is:

1. A vehicle license plate frame for a vehicle providing a source of a sound signal of varying instantaneous strengths comprising a plurality of lamps on the frame for lighting according to a sound signal strength, circuitry for lighting selectively particular ones of the lamps, and a means for connection to a source for receiving the sound signal of varying strength and causing the circuitry to activate simultaneously a varying number of the lamps as a function of an instantaneous strength of the sound signal.

2. A vehicle license plate frame according to claim 1, and a vehicle in combination therewith having a license plate that mounts on the frame via holes aligned in the license plate and the frame, and a steady-voltage means for powering the circuitry to activate a varying number of the lamps as a function of the strength of the sound signal.

3. A rectangular vehicle license plate frame having side columns, a plurality of light emitting diodes mounted in each side column so as to be visible externally, a printed circuit board in each column, and circuitry on each printed circuit board for the light emitting diodes in that column for activating a number of light emitting diodes proportionate to an instantaneous strength of a sound signal.

4. A rectangular vehicle license plate frame according to claim 3, wherein each PC board is adapted to receive separate sets of input signals.

5. A rectangular vehicle license plate frame according to claim 4, for a vehicle stereo system having two channels each providing a set of output signals, wherein the circuitry on each board includes connection means for tapping the output signals of one of the two channels of a vehicle stereo system for its column of light emitting diodes.

6. A rectangular vehicle license plate frame according to claim 5, wherein the circuitry on each board includes a transformer for being driven through a trimmer resistor on the printed circuit board, and openings in the frame side columns for adjusting the trimmer resistors.

7. A rectangular vehicle license plate frame according to claim 6, wherein the circuitry on each board includes a transformer providing transformed signal to an integrated circuit chip connected to the light emitting diodes.

8. A rectangular vehicle license plate frame according to claim 5, and a vehicle in combination therewith having a license plate that mounts via aligned holes in the license plate and the frame, and a stereo system in the vehicle having two electrical output channels each providing a set of output signals and which channels are tapped by the circuitry connection means.

9. A rectangular vehicle license plate frame according to claim 3, for a vehicle having an audio system providing output signals to its speakers, wherein the circuitry on each board includes connection means for tapping the output signals of the audio system.

10. A rectangular vehicle license plate frame according to claim 9, wherein the circuitry on each board includes a transformer adapted for being driven by the audio system providing output signals.

11. A rectangular license plate frame according to claim 10, wherein the audio system provides output signal of low voltage and varies in strength, and a transformer is adapted to be connected to a power source for stepping up the voltage.

12. A rectangular license plate frame according to claim 11, wherein the printed circuit board includes an integrated chip that is fed by the transformer and is for distributing electricity to a number of light emitting diodes.

13. A rectangular vehicle license plate frame having a pair of sides, columns and a pair of rows for a vehicle providing an electrical sound signal of varying strength, a plurality of light emitting diodes mounted in one of said pair of side columns so as to be visible externally, a printed circuit board in said plate frame, and circuitry on said printed circuit board for activating simultaneously a varying number of said plurality of light emitting diodes proportionate to the instantaneous strength of an electrical sound signal.

14. A rectangular vehicle license plate frame having a pair of sides columns for a vehicle providing an electrical sound signal of varying strength, a plurality of light emitting diodes mounted in side columns so as to be visible externally, a printed circuit board in said plate frame, and circuitry on said printed circuit board for activating simultaneously a varying number of said plurality of light emitting diodes proportionate to the instantaneous strength of the electrical sound signal.

15. A rectangular vehicle license plate frame having a pair of sides columns for a vehicle providing an electrical sound signal of varying strength, a plurality of light emitting diodes mounted in said plate frame so as to be visible externally, a printed circuit board in said columns and circuitry on said printed circuit board for activating simultaneously a varying number of said plurality of light emitting diodes proportionate to the instantaneous strength of the electrical sound signal.

* * * * *